US005244426A

United States Patent [19]

Miyashita et al.

[11] Patent Number: 5,244,426

[45] Date of Patent: Sep. 14, 1993

[54] POWER STEERING SYSTEM FOR AN OUTBOARD MOTOR

[75] Inventors: Yasushi Miyashita; Daisuke Aoki, both of Hamamatsu; Daisuke Nakamura, Shizuoka, all of Japan

[73] Assignee: Suzuki Jidosha Kogyo Kabushiki Kaisha, Shizuoka, Japan

[21] Appl. No.: 899,180

[22] Filed: Jun. 15, 1992

Related U.S. Application Data

[63] Continuation of Ser. No. 529,996, May 30, 1990, abandoned.

[30] Foreign Application Priority Data

May 30, 1989 [JP] Japan ..... 1-134721
Jun. 8, 1989 [JP] Japan ..... 1-143970
Jun. 30, 1989 [JP] Japan ..... 1-167123

[51] Int. Cl.[5] ..... B63H 5/12

[52] U.S. Cl. ..... 440/60; 114/144 R; 440/53

[58] Field of Search ..... 440/53, 60-63, 440/900, 75, 76; 180/141-143, 148, 79.1; 74/388 PS; 114/362, 144 E, 144 R, 154-159

[56] References Cited

U.S. PATENT DOCUMENTS 3,631,833 1/1972 Shimanckas ..... 440/61 X
4,371,348 2/1983 Blanchard ..... 440/78 X
4,432,737 2/1984 Johansson ..... 440/60
4,708,087 11/1987 Potter, Jr. ..... 114/362
4,800,975 1/1989 Oshita et al. ..... 180/79.1 X
4,992,944 2/1991 Noto et al. ..... 180/79.1 X

FOREIGN PATENT DOCUMENTS 0114590 5/1989 Japan ..... 440/60

*Primary Examiner*—Edwin L. Swinehart
*Attorney, Agent, or Firm*—Finnegan, Henderson, Farabow, Garrett & Dunner

[57] ABSTRACT

A power steering system for an outboard motor for steering an outboard motor disposed outside of a rear portion of a hull and usually including a manual steering system mounted upon the hull for operating a steering element so as to manually steer the outboard motor body, is disclosed. A power unit is operatively connected to the manual steering system and includes an electric motor for applying a steering assist force to the manual steering system. The power unit is located at the portion of the hull capable of effectively utilizing the inner space of the hull and the electric motor of the power unit is controlled by means of a control unit in accordance with the navigation conditions of the hull and the operating conditions of the outboard motor as detected by means of suitable sensors. The sensors comprise various sensors such as, for example, a steering torque sensor and an engine speed sensor.

9 Claims, 19 Drawing Sheets

POWER STEERING SYSTEM FOR AN OUTBOARD MOTOR

This application is a continuation of application Ser. No. 07/529,996, filed May 3, 1990, now abandoned.

FIELD OF THE INVENTION

The present invention relates to a power steering system for an outboard motor, and more particularly to a system having an improved power unit for applying a steering assist force to a manual steering system, and for suitably controlling the steering assist force.

BACKGROUND OF THE INVENTION

A conventional manually operative steering system of an outboard motor exhibits a significant problem, such as, for example, the fact that the steering load increases, which may result in difficulty in performance of the steering operation, in accordance with navigation conditions, such as, for example, wind or wave conditions, hull speed, trim angle of the outboard motor body and the like.

In order to obviate the problem encountered with the conventional manual steering system, a hydraulic power steering system has been proposed.

The proposed hydraulic power steering system is generally composed of the manual power steering system and a power unit equipped with a hydraulic pump for generating a steering assist force. The power unit applies the steering assist force to the manual power steering system.

However, the hydraulic power steering system described above utilizes the power source of the outboard motor itself as the power source of the hydraulic pump. Accordingly, the steering assist force generated by means of the hydraulic pump is changed in response to the revolutions per minute of the engine, that is, the engine speed, mounted upon the outboard motor, which may not be suitably controlled according to the navigation conditions.

OBJECTS OF THE INVENTION

An object of this invention is to substantially eliminate the defects or drawbacks of the conventional technology and to provide a power steering system for an outboard motor which is capable of easily and suitably steering an outboard motor body by means of a small steering load which is free from the changes of the navigation conditions.

Another object of this invention is to provide a power steering system for the outboard motor which is capable of reducing the necessary space of the power steering system required within the hull so as to thereby render the system applicable to a small sized hull.

SUMMARY OF THE INVENTION

These and other objects can be achieved according to the present invention, in accordance with one aspect thereof, by providing a power steering system for an outboard motor for steering the outboard motor body of the outboard motor disposed outside of a rear portion of the hull and provided with an engine and a propeller driven by means of the engine, the power steering system comprising a manual steering system mounted upon the hull for operating a steering element so as to manually steer the outboard motor body, a power unit operatively connected to the manual steering system and including an electric motor for applying a steering assist force to the manual steering system, a sensor means for detecting navigation conditions of the hull and the outboard motor, and control means for controlling the electric motor of the power unit so as to generate the steering assist force in accordance with the navigation conditions detected by the sensor means.

In accordance with preferred embodiments of the present invention, the sensor means operatively connected to the control means is provided with a steering torque sensor for detecting steering torque during operation of the manual steering system, an engine speed sensor for detecting engine speed and a steering sensor for detecting steering angle and steering direction of the outboard motor body steered by means of the manual steering system.

The control means controls the electric motor of the power unit so as to determine the power assist force required in response to the steering torque detected by means of the steering torque sensor and then converts or refines the determined force into a final applied force in response to the engine speed and the steering angle respectively detected by means of the engine speed sensor and the steering angle sensor.

The sensor means comprises a thrust sensor operatively connected to the control means for detecting the thrust force generated by means of the propeller of the outboard motor.

The control means controls the electric motor of the power unit so as to generate the steering assist force in proportion to the thrust force detected by means of the thrust sensor.

The outboard motor is provided with a power trim-tilt system for automatically trimming and tilting the outboard motor body and the thrust sensor directly detects the pressure of the pressurized oil operating the power trim-tilt system so as to indirectly detect the thrust generated by means of the propeller.

In accordance with another aspect of the present invention, there is provided a power steering system for an outboard motor for steering an outboard motor body of the outboard motor disposed outside of a rear portion of the hull, the power steering system comprising a manual steering system mounted upon the hull for operating a steering element so as to manually steer the outboard motor body and a power unit operatively connected to the manual steering system and including an electric motor for applying a steering assist force to the manual steering system and a transmission means for transmitting the power generated by means of the electric motor, the electric motor being accommodated within a motor box means located outside the hull.

In preferred embodiments, the transmission means is accommodated within a transmission box means located outside the hull. The hull is provided with a transom at the rear portion thereof and the transmission means comprises reduction gears, a rack and a pinion, the reduction gears being accommodated within a gear box located outside the hull, the rack and pinion being accommodated within a rack box located above a surface of the transom.

According to the present invention having the characteristics and structures described above, the power steering system of the outboard motor comprises a control means which sets the steering assist force applied to the manual steering system in accordance with the engine speed and the steering angle respectively detected by means of the engine speed sensor and the steering angle sensor as well as the steering torque detected by means of the steering torque sensor, so that the steering assist force can be suitably controlled in accordance with or regardless of the navigation conditions of the hull.

In addition, the control means sets the steering assist force so as to be proportional to the thrust force generated by means of the propeller of the outboard motor and affect the steering load, so that the steering assist force can be controlled so as to correspond to the fluctuation of the steering load. Thus, the power steering system can easily and suitably steer the outboard motor body by means of a small load which is free from the navigation conditions, thereby improving the steering feeling and operation.

Furthermore, according to the present invention, the power steering system comprises the motor box in which the electric motor of the power unit is accommodated and the transmission box in which the transmission means for transmitting the steering assist force generated by means of the electric motor to the manual steering system is accommodated. The motor box and the transmission box are located outside the rear portion of the hull at which position the outboard motor is disposed, thereby reducing the location space of the power steering system required within the hull and, hence, the power steering system can be applied to a small sized craft so as to improve the usage thereof.

BRIEF DESCRIPTION OF THE DRAWINGS

For a better understanding of the present invention and to show how the same is carried out, reference is now made to, by way of preferred embodiments, the accompanying drawings, in which like reference characters designate like or corresponding parts throughout the several views, and wherein.

DESCRIPTION OF THE PREFERRED EMBODIMENTS

In advance of the detailed description of the preferred embodiments of the present invention, the conventional art will be described hereunder with reference to FIGS. 24 and 25.

Figure 24:
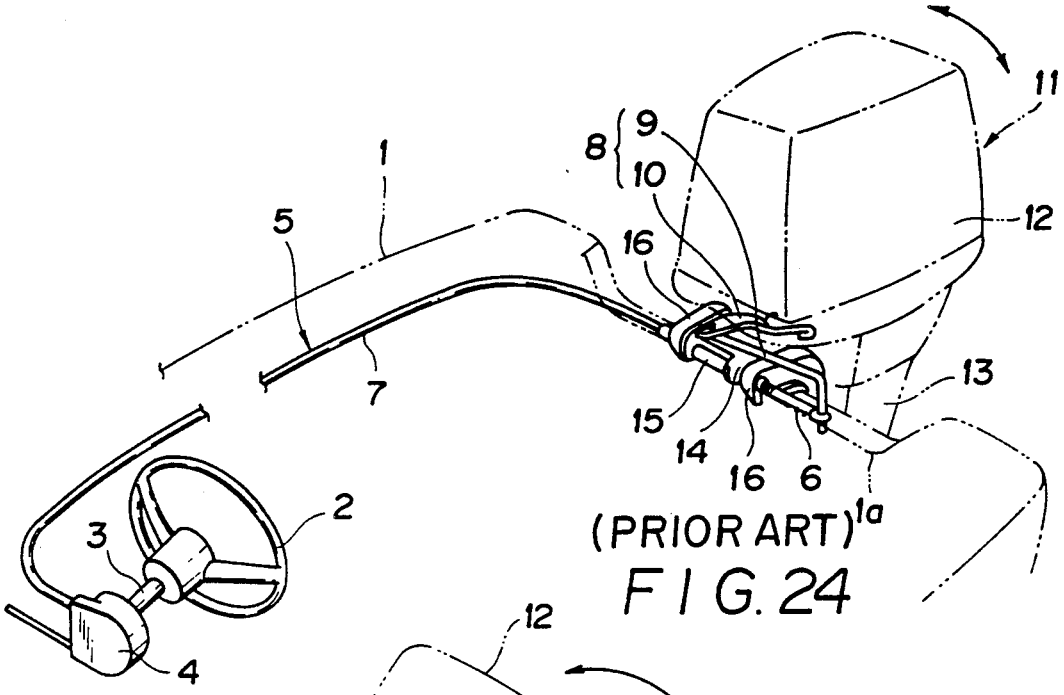
(PRIOR ART) FIG. 24
FIG. 24 is a perspective view of a conventional manual steering system.

Referring to FIG. 24 showing a manual steering system for an outboard motor, when an operator controls steering wheel 2 disposed at a driving station within a hull 1, a gear within a gear box 4 is rotated through means of a steering shaft 3. In response to the rotation of the gear, an inner cable 6 of a steering cable 5 is reciprocated axially forwardly or backwardly (push-pull motion). The steering cable 5 comprises an outer cable 7 and the inner cable 6 coaxially located therein.

The front end of the inner cable 6 extends slightly beyond the front end of the outer cable 7 and is connected to one end of a drag link 9 of a link mechanism 8. The drag link 9 has an L-shaped configuration and has the other end thereof connected to one end of a steering bracket 10 which is pivotable. The other end of the steering bracket 10 is secured to a body 12 of the outboard motor 11.

Figure 25:
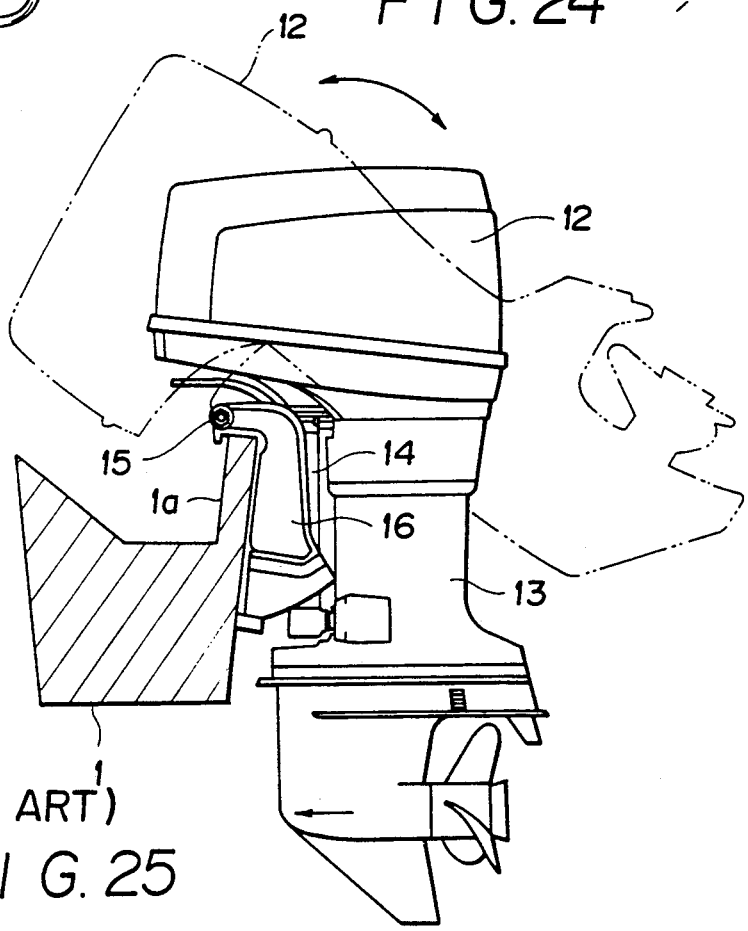
(PRIOR ART) FIG. 25
FIG. 25 is a side view representing the tilt-up and tilt-down conditions of the outboard motor body shown in FIG. 24.

As shown in FIG. 25, the outboard motor body 12 comprises a drive shaft housing 13 including a drive shaft, not shown. The outboard motor body 12 is supported by means of a swivel bracket 14 through means of a pilot shaft, not shown, which is secured to the drive shaft housing 13 so as to be horizontally rotatable or steerable around the pilot shaft. The swivel bracket 14 is supported so as to be rotatable, that is, tiltable, in a vertical direction by means of a clamp bracket shaft 15 which is horizontally mounted between a laterally spaced pair of clamp brackets 16 and 16, by means of which a transom la of the hull 1 thereby mounts the outboard motor body 12 to the hull 1. Accordingly to the structure described above, the outboard motor body 12 is horizontally bilaterally swung about the pilot shaft by means of the push-pull motion of the inner cable 6 by the steering cable 5 through means of the link mechanism 8, whereby the outboard motor body 12 is able to be steered.

However, with respect to the manual steering system of the conventional type described above, the maneuvering of the outboard motor 11 may involve much labor as a result of an increase of the steering load applied thereto during the steering operation due to the navigation conditions, such as, for example, wind or wave conditions, hull speed, trim angle of the outboard motor 11, or the like.

In order to obviate the defect of the conventional manual steering system and, hence, to reduce the steering load applied thereto, conventional technology provides a hydraulic power steering system for the outboard motor. However, the hydraulic power steering system of the prior art utilizes a power source of the outboard motor itself as a power source for driving a hydraulic pump of the hydraulic power steering system. Accordingly, the steering assist force generated by means of the hydraulic pump is changed in response to changes in the revolutions per minute of the drive shaft of the outboard motor and may not be suitably controlled in accordance with the navigation conditions.

A power steering system according to the present invention conceived for substantially eliminating the defects or drawbacks encountered within the prior art described above will now be described hereunder with reference to FIGS. 1 to 23.

Figure 1:
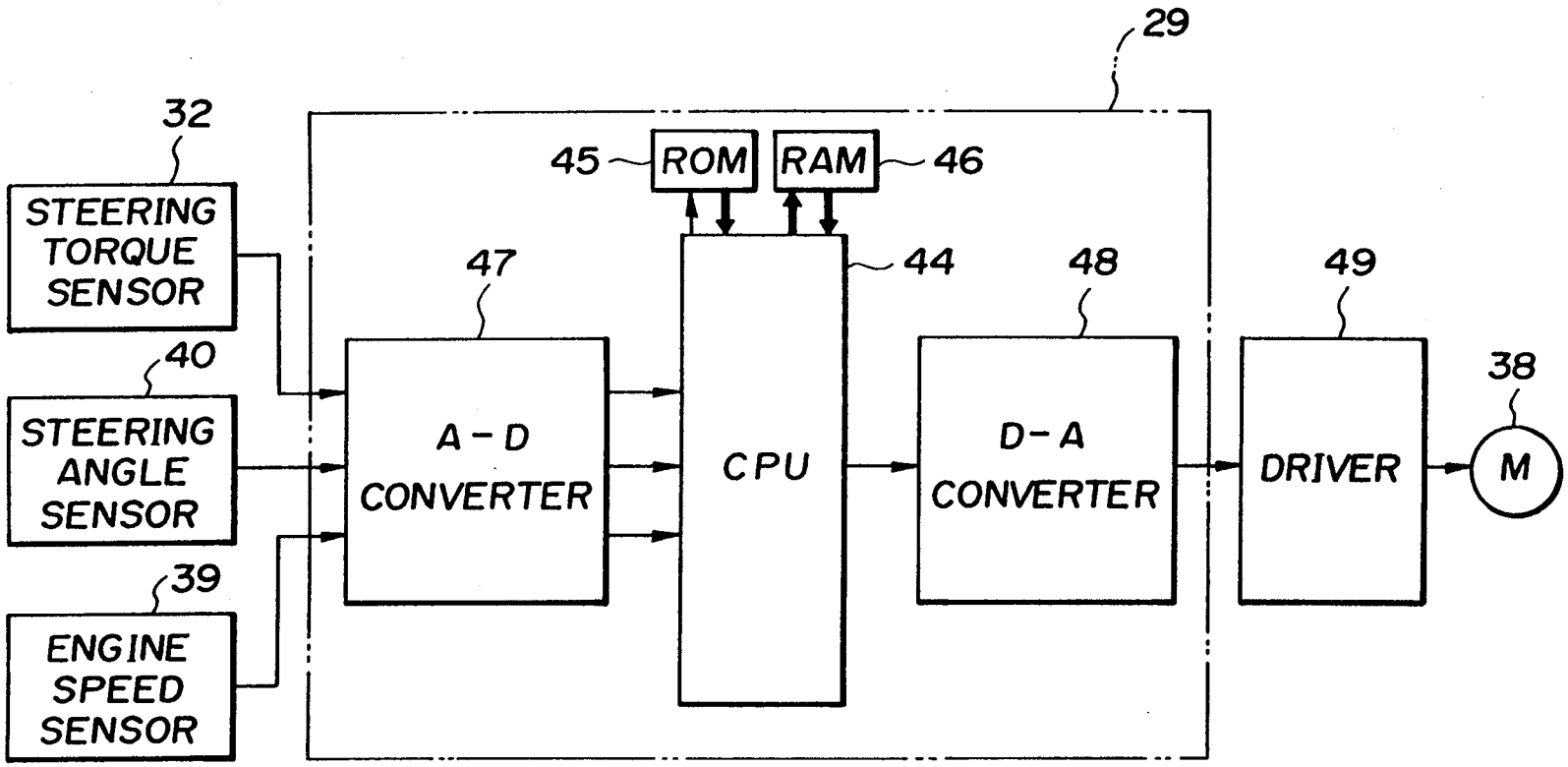
FIG. 1 is a block diagram mainly representing a controller of a power steering system of an outboard motor of the first embodiment according to the present invention.
Figure 2:
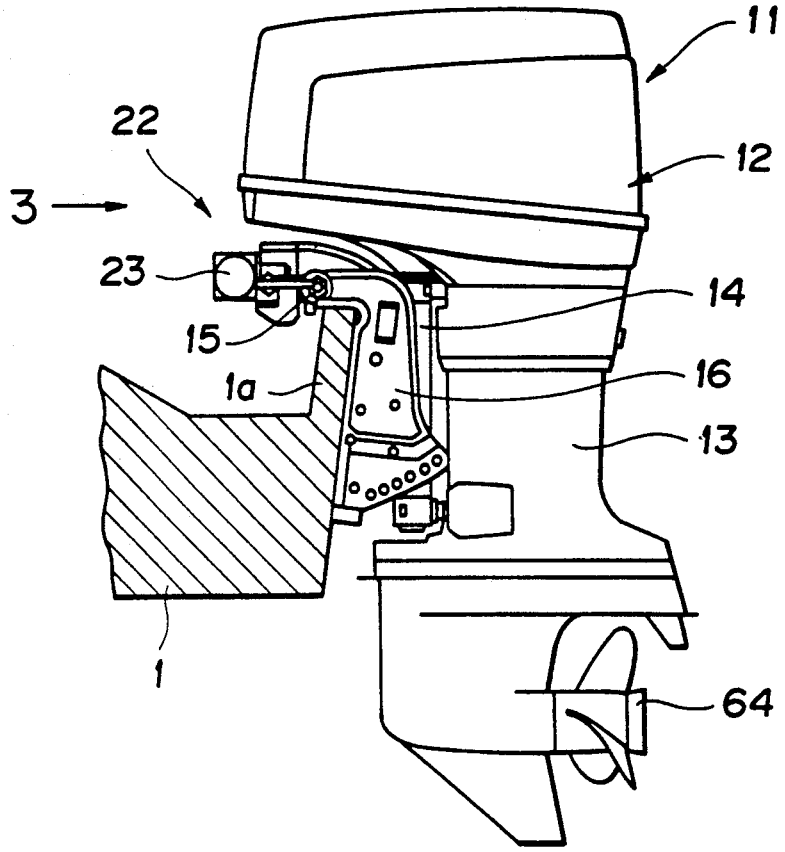
FIG. 2 is a side view of the outboard motor to which the power steering system provided with the controller shown in FIG. 1 is applied.
Figure 3:
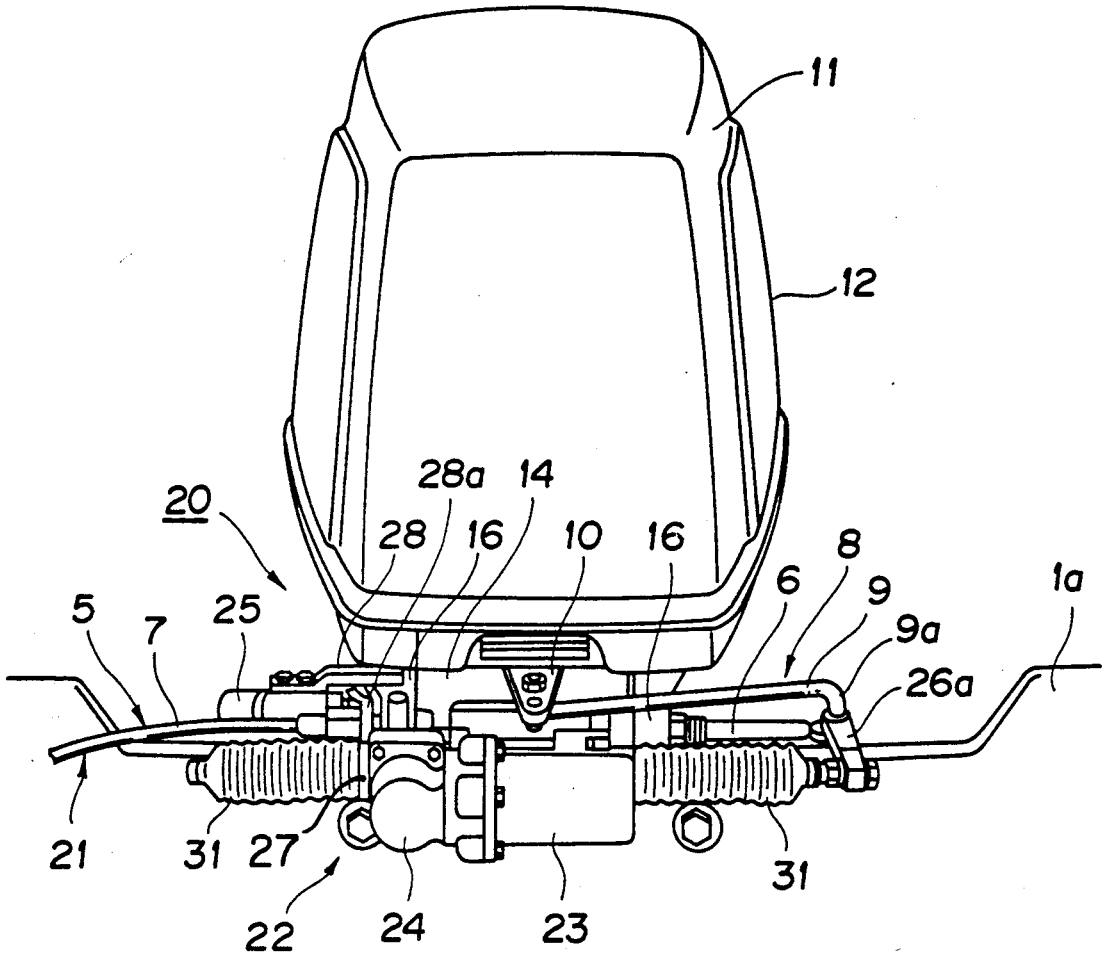
FIG. 3 is a front view of the power steering system of the first embodiment.

Referring to FIGS. 1 to 10 representing the first embodiment according to the present invention, FIG. 3 shows a front view of a power steering system 20 of one embodiment of the present invention. Referring to FIG. 3, the power steering system 20 comprises a manual steering system 21 and a power unit 22 wherein the manual steering system 21 is of the type substantially the same as that shown in FIGS. 24 and 25, so that the like reference numerals are used to designate elements or members corresponding to those shown in FIGS. 24 and 25 and the details thereof are now omitted herefrom.

The power unit 22 acts to apply a steering assist force directed in the same direction as the manual steering force of the manual steering system 21 to an input end of the link mechanism 8 so as to thereby reduce the steering load. The power unit 22 comprises a motor box 23 in which a motor, not shown, is accommodated, a gear box 24 in which a reduction gear is accommodated and a sensor box 25 in which a torque sensor, not shown, is incorporated.

Figures 4, 5:
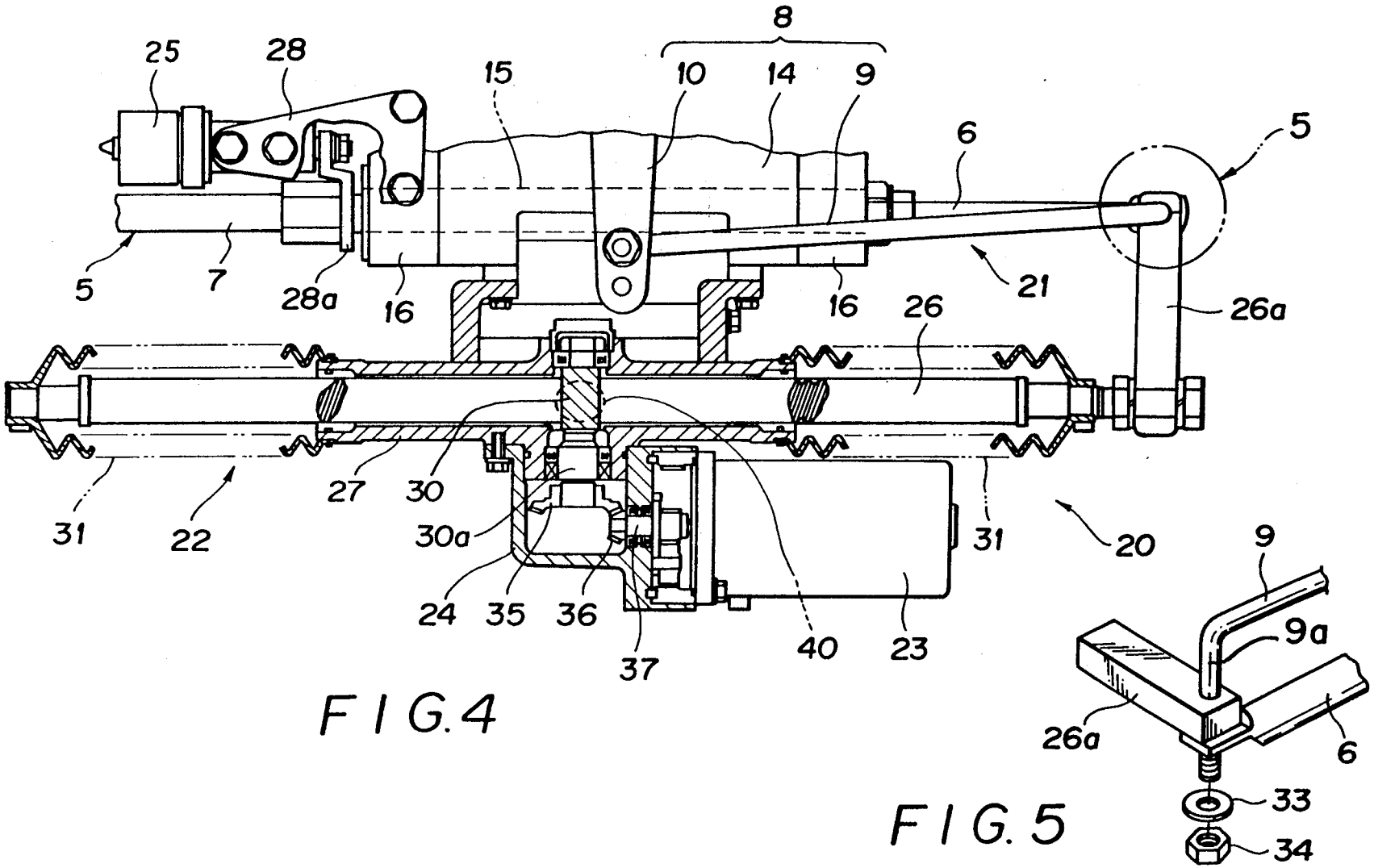
FIG. 4 is a longitudinal sectional view of the power steering system shown in FIG. 3.
FIG. 5 is an enlarged perspective view of a portion of the power steering system enclosed by means of the circle designated by means of the reference character 5 as shown in FIG. 4.

As shown in FIG. 4, the motor box 23 and the gear box 24 are integrally coupled with a rack box 27 in which a rack 26 is accommodated and the integral structure is secured to an upper portion of the swivel bracket 14 of the outboard motor 11 by means of bolts.

The sensor box 25 is secured to one of the paired clamp brackets 16 through means of a support arm 28 and slidably accommodates a sensor rod, not shown, therein. The sensor rod has one end secured to a terminal end of the outer cable 7 by means of a stationary arm 28*a*. The other end of the sensor rod is operatively connected to a potentiometer, not shown, accommodated within the sensor box 25. The potentiometer and the sensor rod described above constitute a steering torque sensor 32 as shown in FIG. 1.

When the inner cable 6 is pushed or pulled with respect to the outer cable 7 by means of the manual operation of the steering wheel 2, the reaction force applied to the outer cable 7 by means of the push or pull motion of the inner cable 6, that is, the steering load, is transmitted to the sensor rod through means of the stationary arm 28*a*. The displacement of the sensor rod is detected by means of the potentiometer disposed within the sensor box 25 and a signal, that is, a steering torque signal, representing the displacement detected by means of the potentiometer is transmitted to a controller 29 described later herein and shown in FIG. 1.

As shown in FIG. 4, the rack box 27 has axial ends to which shrinkable cylindrical bellows 31 and 31 are coaxially secured and the rack 26 is accommodated within the rack box 27 in an axially reciprocating and liquid-tight manner. The rack 26 has one axial end (right end as viewed in FIG. 4) secured to a stay 26*a* and, as shown in FIG. 5, the stay 26*a* is connected to a bent end 9*a* of the drag link 9 which is disposed in a direction normal to link 9 by means of a washer 33 and a nut 34. The rack 26 is engaged with a pinion 30 at an intermediate portion thereof, which is fixed to a pinion shaft 30*a*. The pinion shaft 30*a* is operatively connected to the motor shaft 37 of the motor 38, shown in FIG. 1, through means of reduction gears 35 and 36 which are in the form of bevel gears and are engaged with each other. Accordingly, when the motor 38 is driven, the pinion 30 is rotated through means of the reduction gears 35 and 36 so as to thereby move the rack 26 in the linear direction thereof, whereby the rotating power of the motor 38 is transmitted to the link mechanism 8 as the steering assist force for reducing the steering load so as to thereby easily steer the outboard motor body 12.

Referring to FIG. 1, an engine speed sensor 39 detects the revolutions per minute of the engine (that is, the engine speed), not shown, mounted within the outboard motor body 12 and transmits a signal representing the engine speed, that is, an engine speed signal, to the controller 29.

Figure 6:
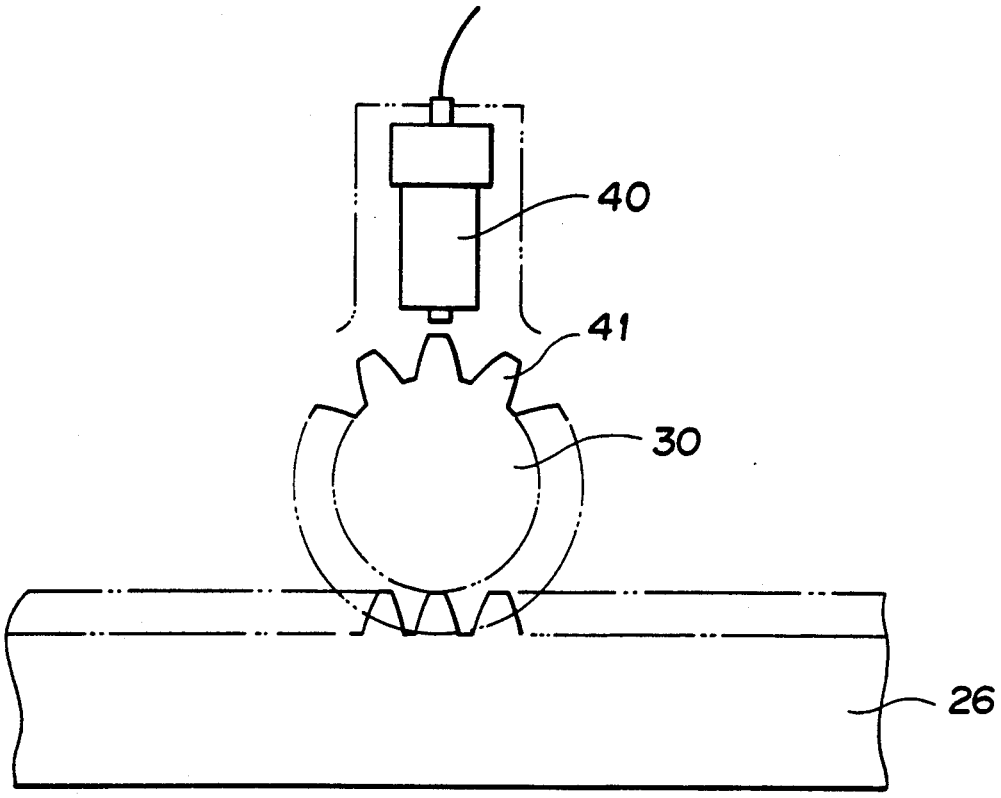
FIG. 6 is an illustration representing an arrangement of a steering angle sensor shown in FIG. 4.
Figure 7:
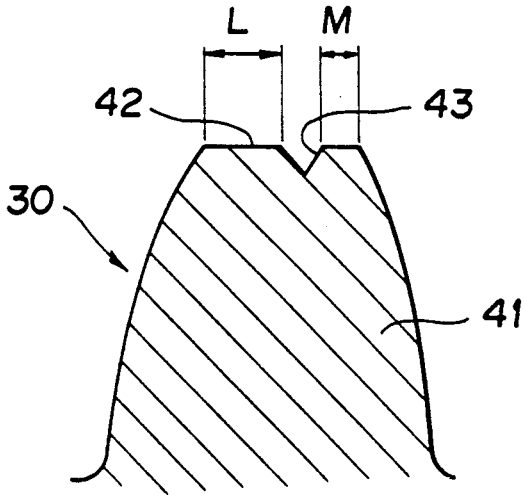
FIG. 7 is a sectional view representing a gear tooth of a pinion shown in FIG. 6.

A steering angle sensor 40 utilizes a non-contact electromagnetic sensor and is arranged so as to be disposed opposite to the pinion 30 as shown in FIG. 6. When an operator operates the steering wheel 2 so as to move the inner cable 6 of the steering cable 5 and to rotate the pinion 30 through means of the stay 26*a* and rack 26, the steering angle sensor 40 counts the number of gear teeth 41 of the pinion 30 so as to thereby detect the steering angle of the outboard motor body 12. Referring to FIG. 7, each of the gear teeth 41 of the pinion 30 has a top land 42 upon which a cutout portion 43 is formed in such a manner so as not to decrease or adversely affect the strength of the pinion 30. The cutout portion 43 is formed so as to be disposed in an asymmetrical manner such that the position of the cutout portion 43 is disposed such that the ends thereof are at distances L and M respectively from bilateral ends of the top land 42. Accordingly, when the steering angle sensor 40 detects this asymmetrical cutout portion 43, detected voltage waveforms of the gear teeth 41 of the pinion 30 are asymmetrical, thus detecting the direction of rotation of the pinion 30, that is, the steering direction of the outboard motor body 12. The steering angle sensor 40 transmits signals representing these steering angles and steering directions described above as steering angle-direction signals to the controller 29.

Referring to FIG. 1, the controller 29 is composed of a central processing unit (CPU) 44, memory units comprising a read only memory (ROM) 45 and a random access memory (RAM) 46 and signal converters comprising an analog-to-digital converter (A-D converter) 47 and a digital-to-analog converter (D-A converter) 48.

Figure 8:
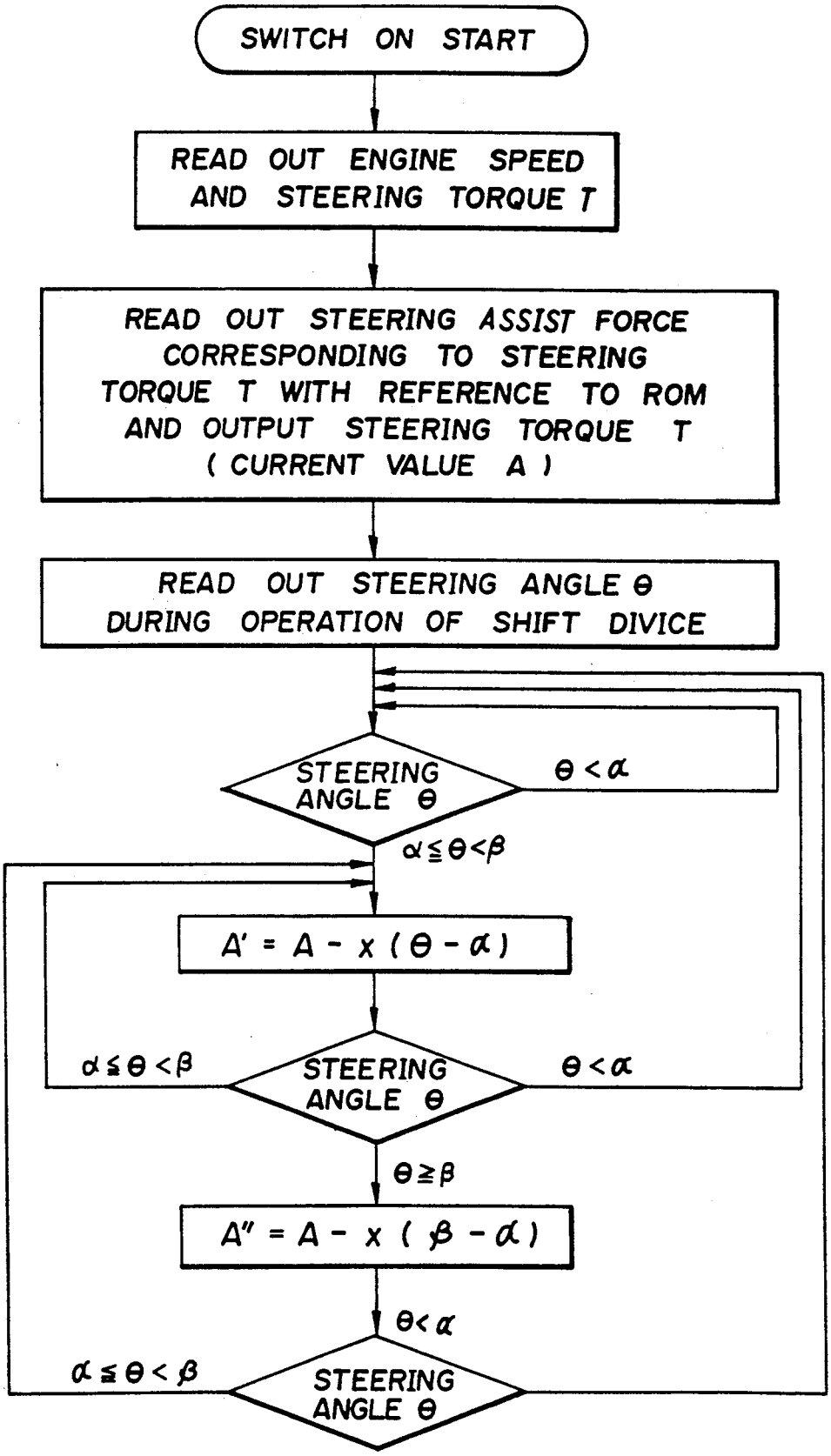
FIG. 8 is a flowchart representing control conditions of the controller shown in FIG. 1.
Figure 9:
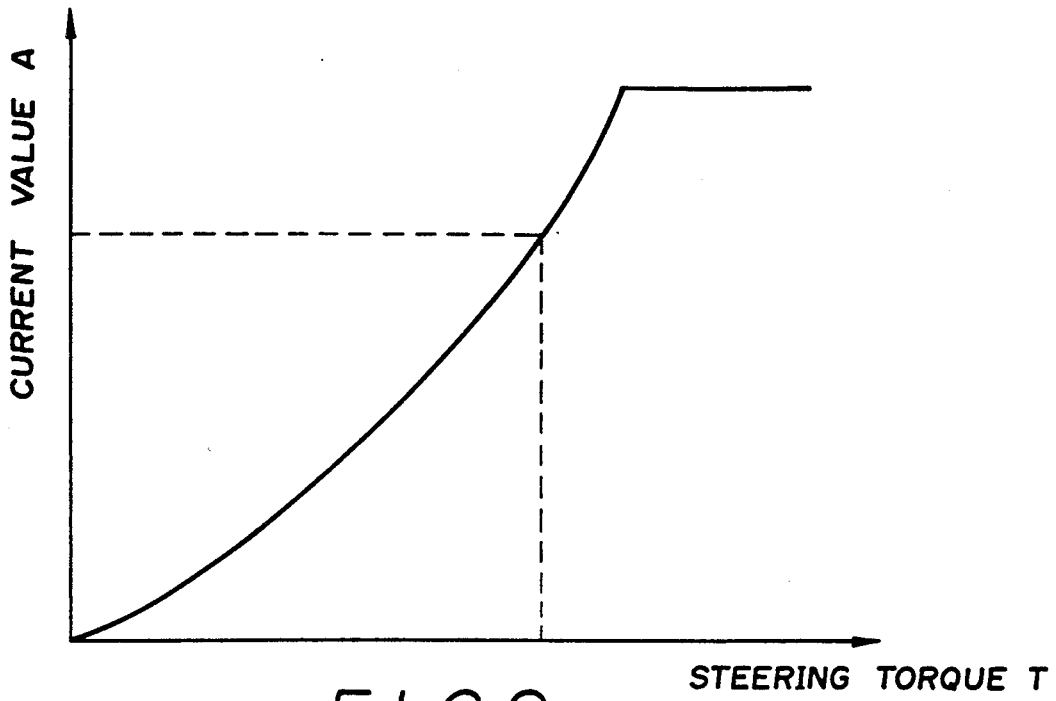
FIG. 9 is a graph representing the relationship between the steering torque and the current value supplied to a motor, which is memorized within the ROM shown in FIG. 1.

The ROM 45 has a data-table, as shown in FIG. 9, representing the relationship between the steering torque T and the current value A supplied to the motor 38. The steering assist force applied to the link mechanism 8 from the power unit 22 is determined in accordance with the current value A supplied to the motor 38. Referring to FIG. 8, CPU 44 reads the steering torque signal and the engine speed signal from the steering torque sensor 32 and the engine speed sensor 39 respectively through means of the A-D converter 47 when the START switch is ON, and then determines the current value A to be supplied to the motor 38 for generating the steering assist force corresponding to the steering torque T represented by means of the steering torque signal with reference to the data-table memorized within the ROM45.

Figure 10:
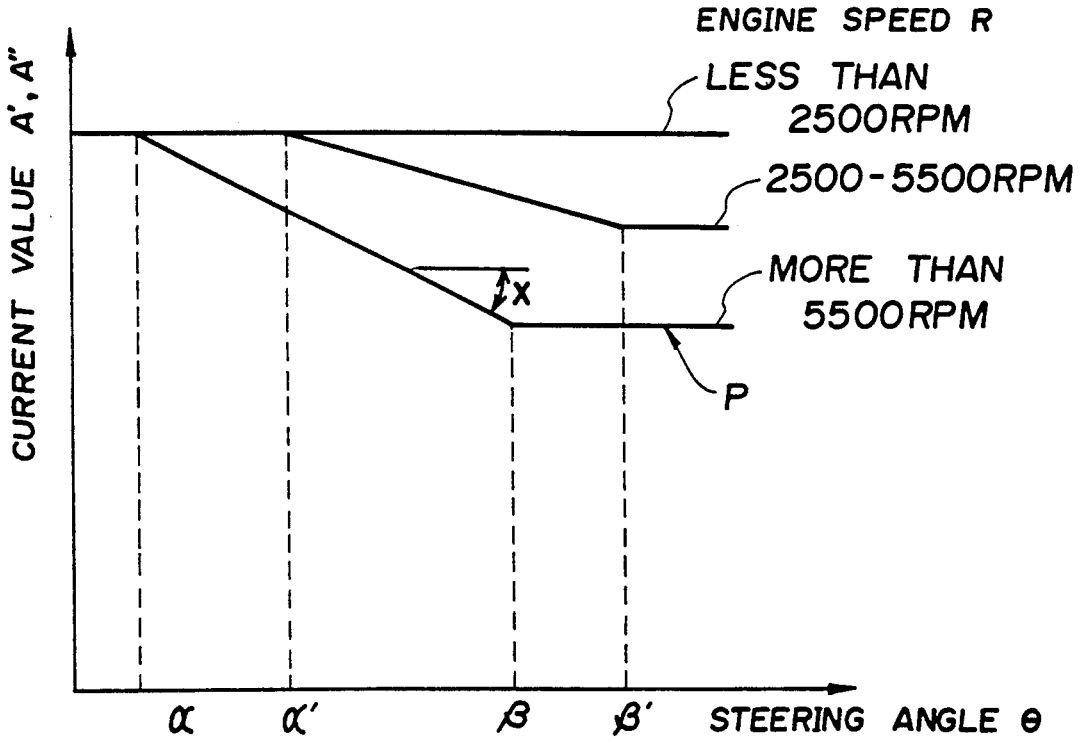
FIG. 10 is a graph representing the relationship between the engine speed, the steering angle and the current value to the motor, which are memorized within the RAM shown in FIG. 1.

The RAM 46 has a data-table, as shown in FIG. 10, representing the relationship between the steering angle Θ, the engine speed R and the current values A′ and A″ supplied to the motor 38. Referring to the FIG. 8, the CPU 44 continually reads the steering angle Θ through means of the A-D converter 47 during the operation of a shift device accommodated within the outboard motor body 12. The CPU 44 then transits the steering angle Θ data to the RAM 46 and simultaneously calculates the proper current value so as to the adjust the current A as determined by means of the data-table memorized within the ROM 45.

Namely, the characteristics of the current values A′ and A″ memorized within RAM 46, as shown in FIG. 10, are different in accordance with the engine speed R even for the same steering angle Θ. The CPU 44 selects one of these characteristics of the current values A′ and A″ in accordance with the engine speed signal transmitted from the engine speed sensor 39 and, for example, selects a characteristic curve represented by means of a full line P as viewed in FIG. 10 in the case where the engine speed R is more than 5500 r.p.m. This characteristic curve represented by means of the full line P designates the supplied current value A determined by means of the data-table as shown in FIG. 9 in the case where the steering angles is less than the steering angle $\alpha$ ($\Theta<\alpha$), the designates the supplied current value A′ determined by means of the formula described such as, for example, $$A'=A-X(\Theta-\alpha)$$

in the case where the steering angles is more than the steering angle $\alpha$ and less than a steering angle $\beta$ ($\alpha<\Theta<\beta$; $\alpha<\beta$), thus reducing the steering assist force determined by means of the supplied current value A′. The letter X represents a gradient of the full line P as shown in FIG. 10 for the condition wherein $\alpha<\Theta<\beta$. The characteristic curve represented by means of the full line P thus designates the supplied current value A″ determined by means of the formula described such as, for example, $$A''=A-X(\beta-\alpha)$$

in the case where the steering angles is more than the steering angle $\beta$ ($\Theta>\beta$). As this supplied current value A″ is constant, the steering assist force determined by means of the current value A″ is also constant. According to the characteristics described above, when the engine speed R is high and the steering angle Θ is large, the controller 29 operates to reduce the current value supplied to the motor 38, thus avoiding a turn-over, for example, of the hull 1.

Referring to FIG. 1, the current value A, A′ or A″ supplied to the motor 38 is transmitted to a driver 49 through means of the D-A converter 48, which amplifies the current value from the controller 29 so as to drive the motor 38 and then conducts the amplified current to the motor 38.

According to the described first embodiment, the controller 29 adjusts the supplied current value A to the motor as determined by means of the steering torque T as derived from the steering torque sensor 32 in accordance with the engine speed R and the steering angle $\theta$ respectively detected by means of the engine speed sensor 39 and the steering angle sensor 40. In the case where the engine speed R is high, the controller 29 preferably supplies to the motor 38 a current value less than the supplied current value A as determined by means of the steering torque T so as to reduce the steering assist force, so that the steering assist force can be suitably controlled in accordance with the navigation conditions. Thus, the power steering system of the outboard motor can easily and suitably steer the outboard motor body with a small steering load.

Figure 11B:
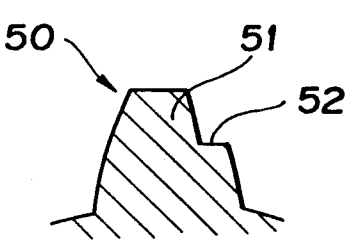
FIG. 11B is an enlarged sectional view of the portion enclosed by means of the circle designated 11B as shown in FIG. 11A.
Figure 11A:
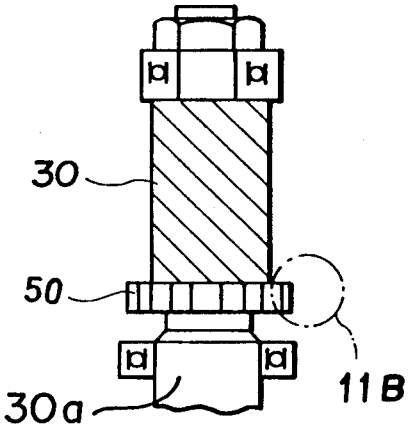
FIG. 11A is a plan view representing the arrangement of a detecting gear comprising one modification of the first embodiment.

FIG. 11A is a fragmentary plan view of one modification according to the first embodiment. In this first modification, the pinion 30 and a detecting gear 50 are coaxially located with respect to the pinion shaft 30*a*, and the detecting gear 50 has gear teeth 41 provided with the cutout portion 43 as shown in FIG. 7 so as to detect the direction of rotation of the pinion 30 or has gear teeth 51, as shown in FIG. 11B, respectively provided with stepped cutout portions 52 so as to similarly detect the direction of rotation of the pinion. The shapes of the teeth of the detecting gear 50 provided with the cutout portion 43 or 52 is detected by means of the steering angle sensor 40. According to this modification, these cutout portions 43 and 52 are formed without adversely affecting the strength of the pinion 30, thus correctly detecting the steering direction of the outboard motor body 12 by means of a voltage wave of the detecting gear 50.

In another modification of the first embodiment, the steering sensor 40 may be arranged so as to directly detect the rotation of the motor 38 so as to detect the steering direction of the outboard motor body 12.

Figure 12:
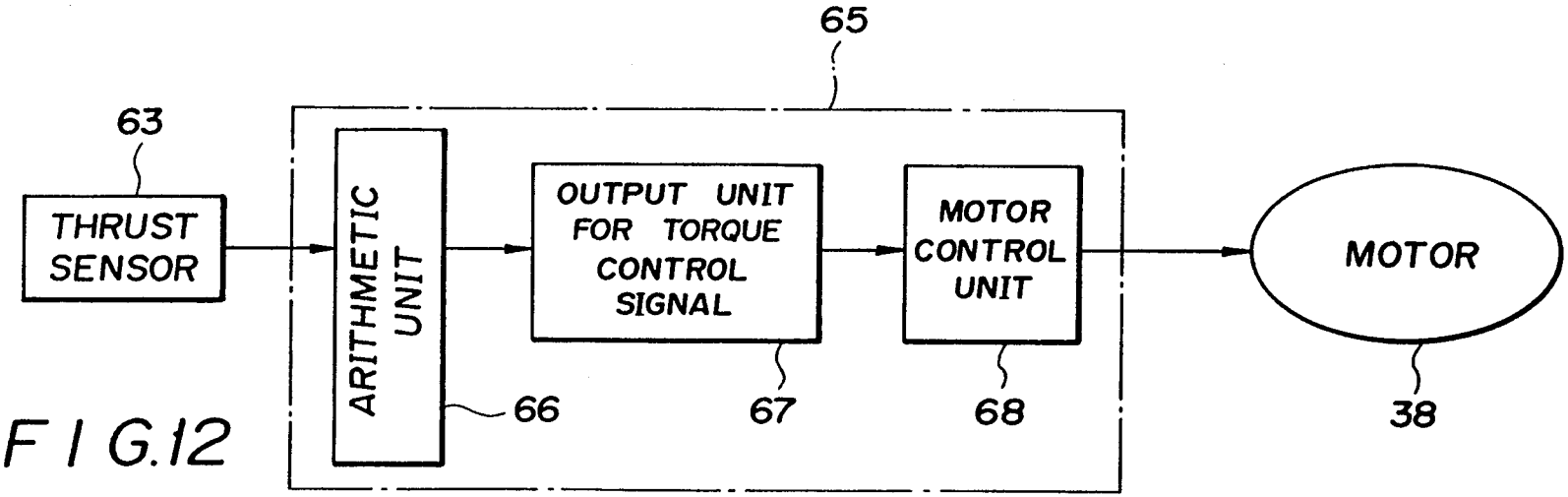
FIG. 12 is a block diagram mainly representing a controller of a power steering system of the second embodiment according to the present invention.
Figure 13:
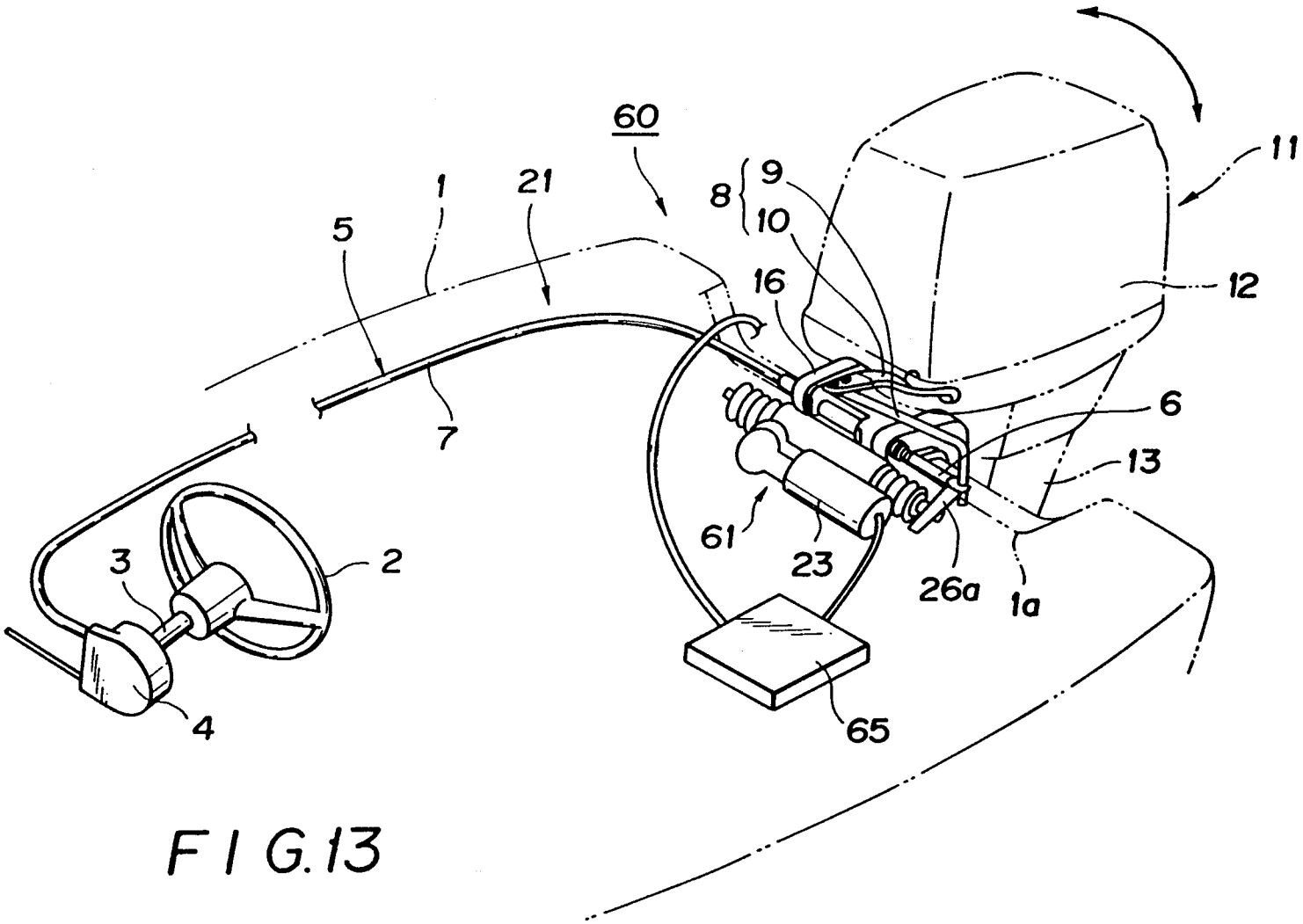
FIG. 13 is a perspective view of the power steering system including the controller shown in FIG. 12.

Referring to FIGS. 12 to 20 representing the second embodiment according to the present invention, FIG. 13 is a perspective view of a power steering system 60 of the second embodiment of the present invention, in which like reference numerals designate portions or members corresponding to those used for the first embodiment shown in FIGS. 1 to 10 and, consequently, a detailed description thereof is now omitted herefrom.

Figure 16:
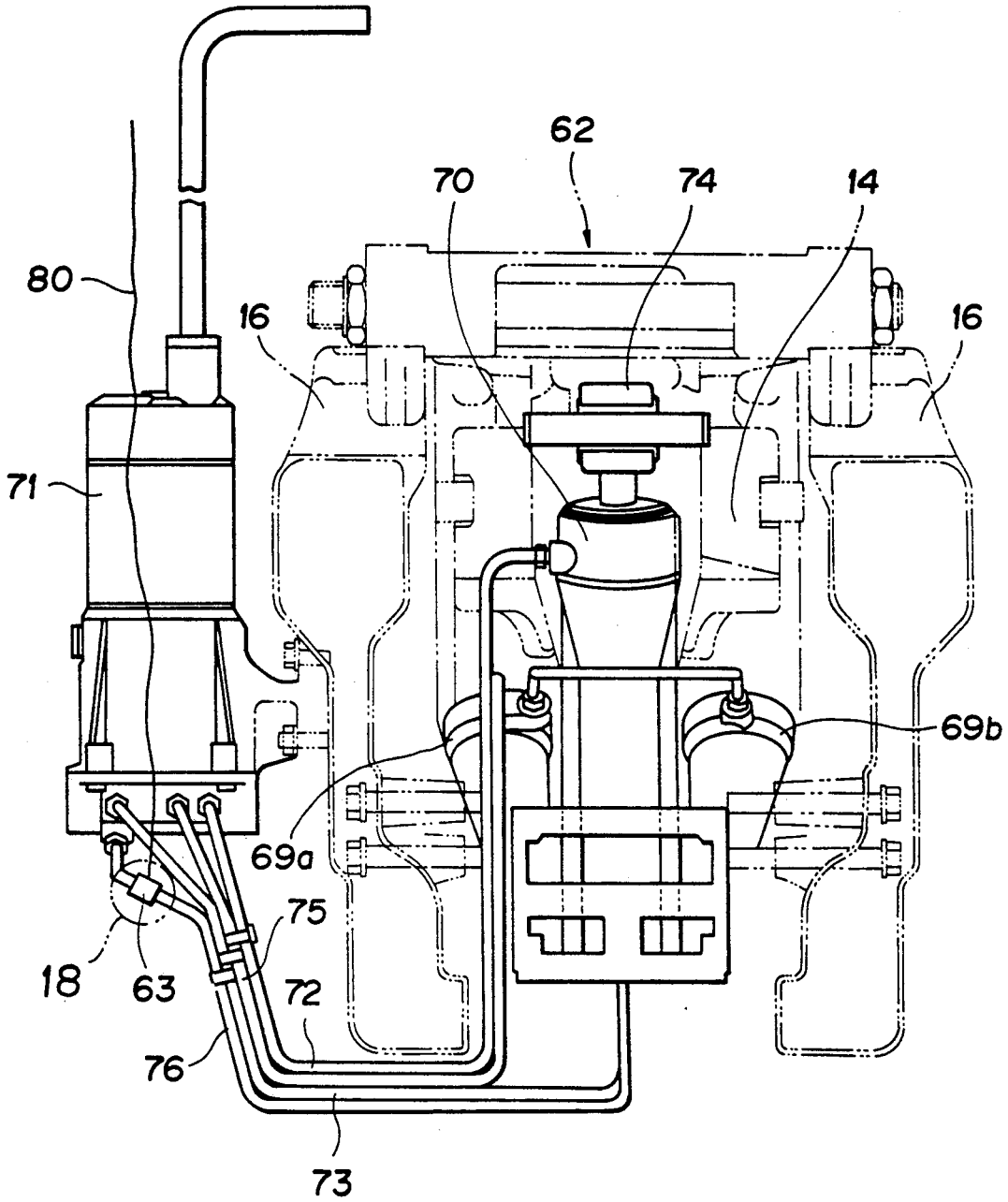
FIG. 16 is a front view of a power trim-tilt system accommodated within the outboard motor body shown in FIG. 14.
Figure 17:
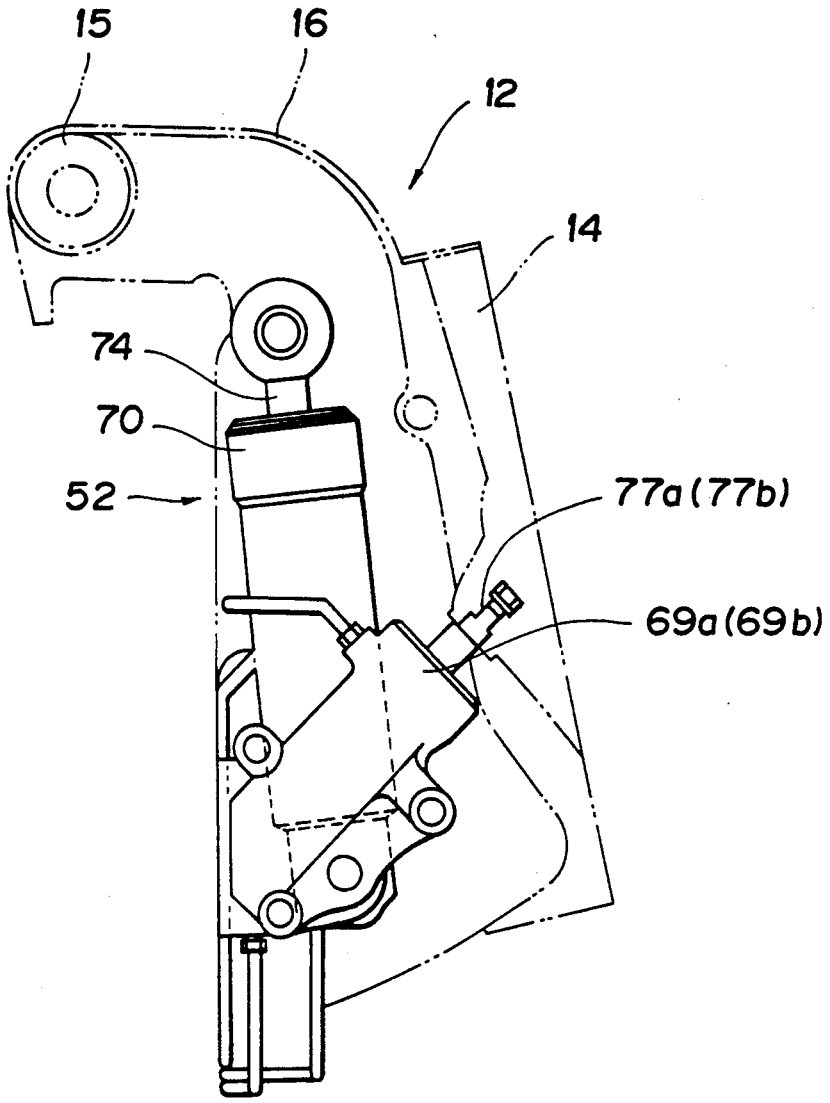
FIG. 17 is a side view of the power trim-tilt system shown in FIG. 16.

In the second embodiment, the power steering system 60 is applied to the outboard motor 11 in which a power trim-tilt system 62 is accommodated, as shown in FIGS. 16 and 17, and comprises the manual steering system 21 and a power unit 61.

Figure 14:
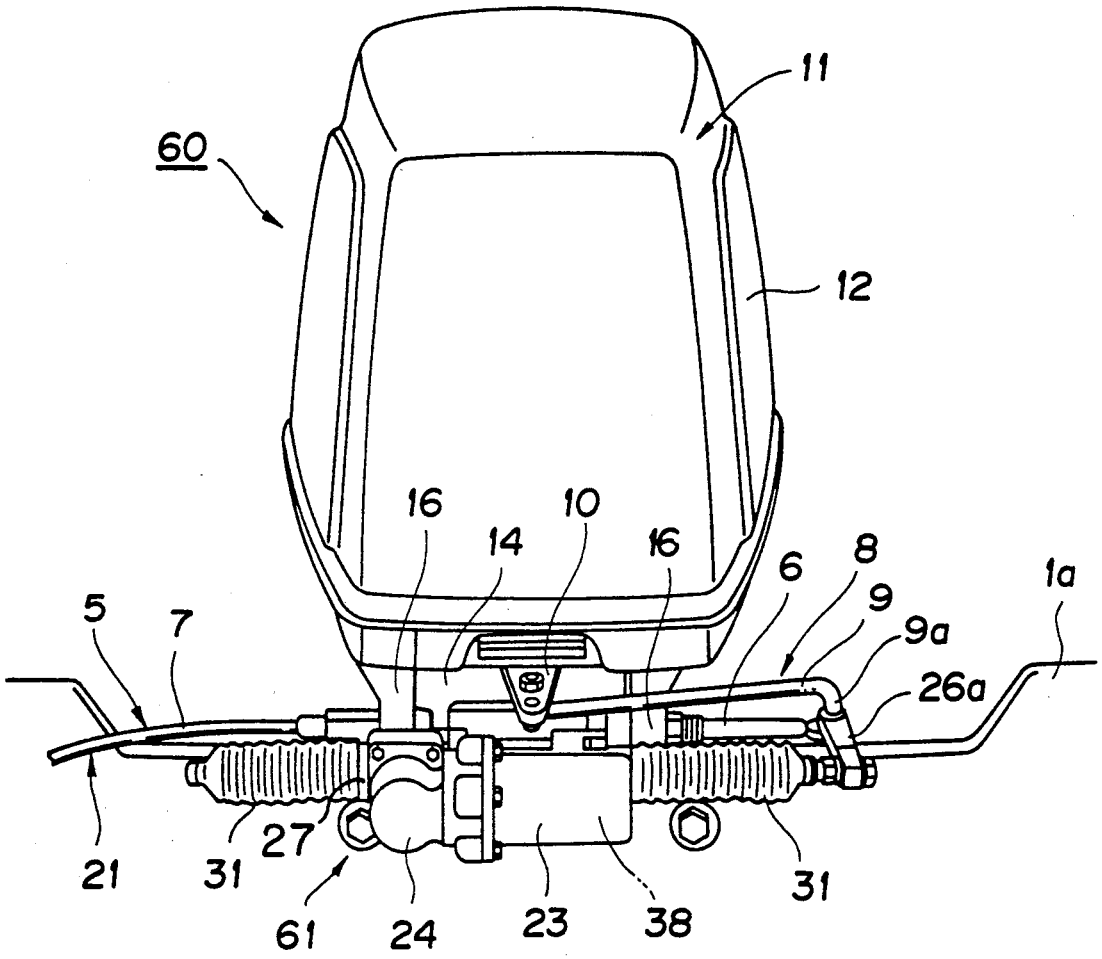
FIG. 14 is a front view of the power steering system of the second embodiment shown in FIG. 12.
Figure 15:
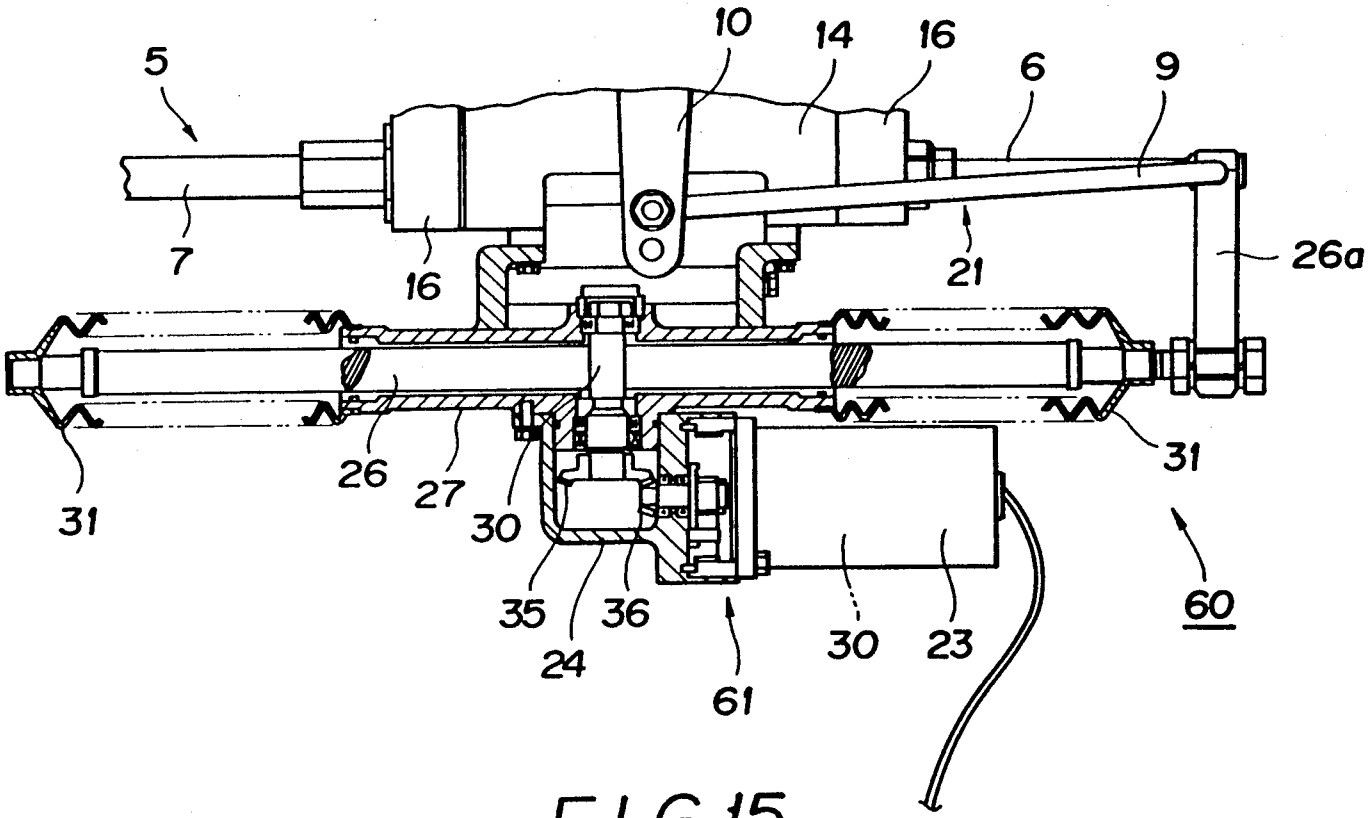
FIG. 15 is a longitudinal sectional view of the power steering system shown in FIG. 14.
Figure 18:
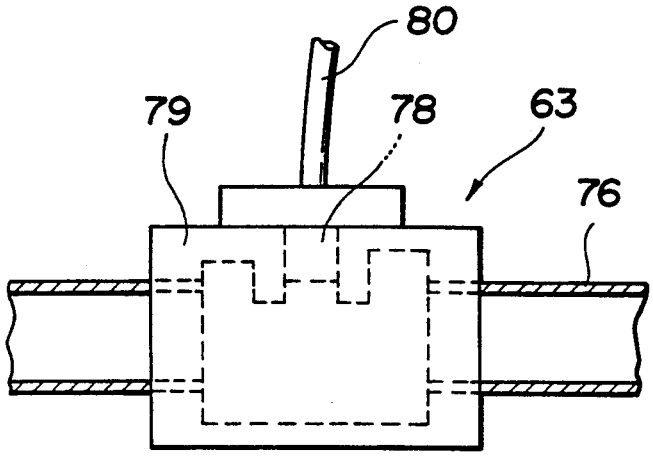
FIG. 18 is a front view of a thrust sensor of the power trim-tilt system shown in FIGS. 12 and 16.

The power unit 61 comprises a thrust sensor 63 as shown in FIGS. 12, 16 and 18, the motor box 23, as shown in FIGS. 13 to 15, in which a motor 38 for generating the steering assist force is accommodated, the gear box 24 in which the reduction gears 35 and 36 for transmitting a turning force are accommodated, and the rack box 27 in which the rack 26 and pinion 30 for transmitting the turning force from the gears 35 and 36 to the drag link 9 of the link mechanism 8 through means of the stay 26*a* are incorporated.

The trust sensor 63, as described later in detail, detects the thrust of the propeller 64, as shown in FIG. 2, of the outboard motor 11 and transmits a trust signal representing the thrust to controller 65 as shown in FIGS. 12 and 13.

Referring to FIG. 12, the controller 65 is composed to an arithmetic unit 66, an output unit 67 for the torque control signal and a motor control unit 68, wherein the arithmetic unit 66 calculates and determines the steering assist force in proportion, for example, to the thrust represented by means of the trust signal and transmits an assist force control signal representing the steering assist force to the motor control unit 68 through means of the output unit 67 as an output member. The motor control unit 68 manipulates, and preferably amplifies the assist force control signal and transmits the amplified signal to the motor 38. Thus the controller 65 controls the rotation of the motor 38 so as to generate the suitable steering assist force.

Namely, the steering load applied to the steering wheel 2 during the steering operation is generally affected by means of the trust force generated by means of the propeller 64 and the force applied to the outboard motor body 12 in the direction of the axis of the propeller 64 or the moment around the pivot shaft, not shown, applied to the outboard motor body 12. The applied force and the moment respectively described above are proportional to the thrust force generated by means of the propeller 64. Accordingly, the controller 65 controls the steering assist force generated by means of the motor 38 so as to be proportional to the thrust force to propeller 64, thus adjusting the steering assist force in accordance with fluctuations of the steering load, whereby the steering feeling can be improved.

Figure 20:
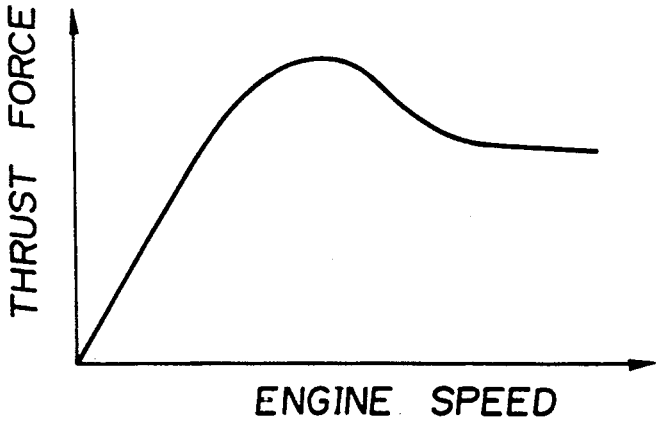
FIG. 20 is a graph generally representing the relationship between the engine speed and the thrust force generated by means of a propeller.

Referring to FIG. 20 in a running craft such as, for example, a motor boat, the thrust force generated by means of the propeller 64 during the engine operation is a maximum before the water-borne operation of the craft and is constant during the water-borne operation of the craft. In this case, the controller 65 controls the steering assist force generated by means of the motor 38 so as to rapidly increase before the water-borne operation of the craft and to be constant during the water-borne operation of the craft in response to the thrust force generated by means of the propeller 64 described above.

Figure 19:
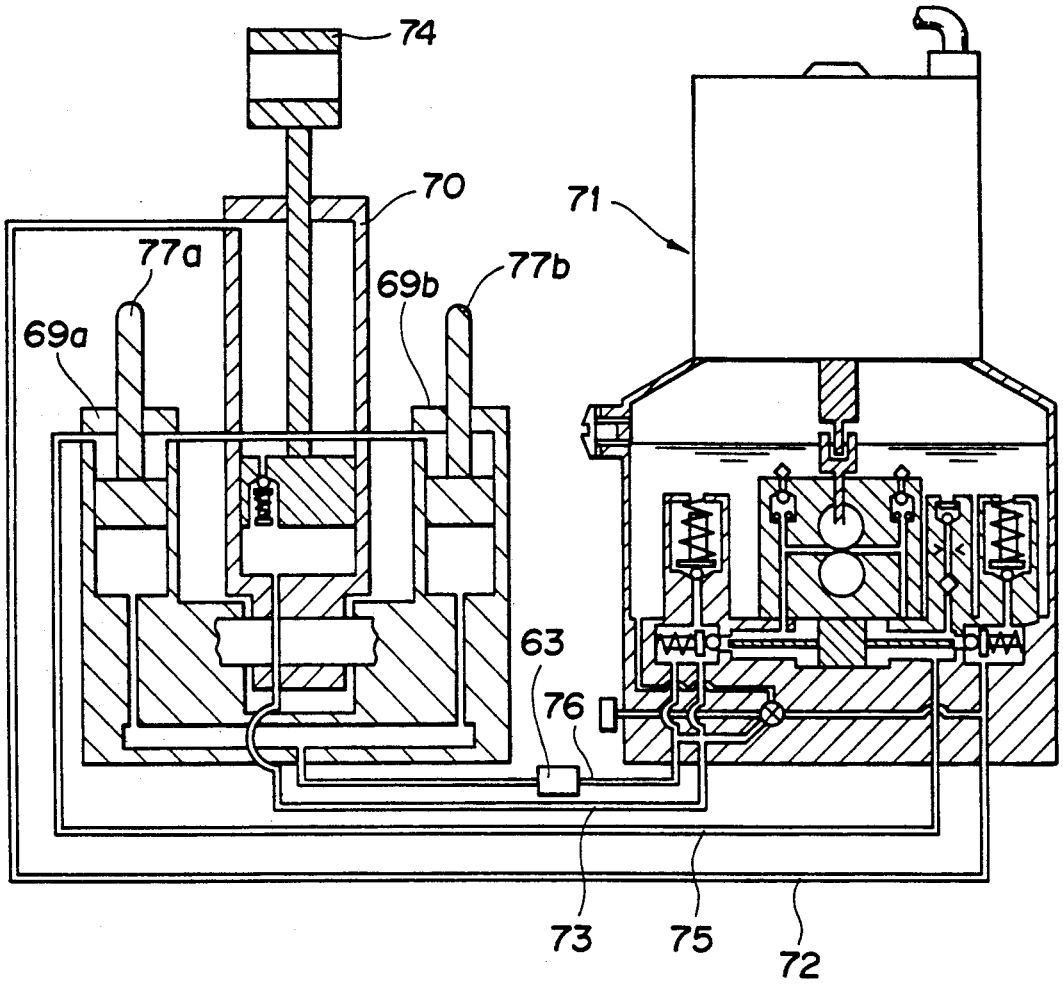
FIG. 19 is a schematic sectional view of the power trim-tilt system shown in FIGS. 16 and 17.

As shown in FIGS. 16 and 17, the power trim-tilt system is composed of a pair of trim cylinders 69*a* and 69*b* accommodated within the outboard motor body 12, a tilt cylinder 70 arranged between the trim cylinders 69*a* and 69*b* within the outboard motor body 12, and an oil pump 71 located outside the outboard motor body 12. Referring to FIG. 19, the oil pump 71 supplies pressurized oil and an inner upper chamber and an inner lower chamber of the tilt cylinder 70 through means of a tilt-down tube 72 and a tilt-up tube 73 respectively, so as to thereby move a piston rod 74 incorporated within the tilt cylinder 70 downwardly and upwardly, whereby the outboard motor body 12 can be automatically tilted downwardly and upwardly, respectively. The oil pump 71 also supplies the pressurized oil to an inner upper chamber and an inner lower chamber of trim cylinders 69*a* and 69*b* through means of a trim-down tube 75 and a trim-up tube 76 respectively, so as to thereby move piston rods 77*a* and 77*b* respectively incorporated within the trim cylinders 69*a* and 69*b* downwardly and upwardly. Thus, the outboard motor body 12 can be automatically trimmed downwardly and upwardly within the range of the tilt angle.

The trim-up tube 76 is interposed between an output end of the oil pump 71 and the inner lower chambers of the trim cylinders 69*a* and 69*b* so as to supply the pressurized oil within the oil pump 71 into the inner lower chambers of the trim cylinders 69*a* and 69*b*. The thrust sensor 63 is disposed within the flow line of the trim-up tube 76 and, as shown in FIG. 18, is composed of a pressure sensor 78 and a sensor body 79 which comprises a liquid-tight hollow box structure secured t the trim-up tube 76. The pressure sensor 78 is accommodated within the sensor body 79 and is adapted to detect the pressure of the pressurized oil within the trim-up tube 76 and then transmit an electric signal representing the detected pressure to the arithmetic unit 66 of the controller 65 through means of a signal cable 80. The pressurized oil within the trim-up tube 76 therefore effectively applies to the outboard motor body 12 a force, which is substantially the same as that of the thrust force generated by means of the propeller 65, in a direction opposite to the thrust force direction so as to thereby hold the hull 1 in a predetermined navigation state with the bow thereof lifted upwardly. Accordingly, the thrust force generated by means of the propeller 65 can be indirectly detected by means of the thrust sensor 63 which directly detects the pressure of the pressurized oil within the trim-up tube 76.

The arithmetic unit 66 of the controller 65, as shown in FIG. 12, has a data-table representing the relationship between the pressure of the pressurized oil within the trim-up tube 76 and the trust force generated by means of the propeller 64, and the arithmetic unit 66 reads the thrust force corresponding to the detected signal from the thrust sensor 63 according to the data-table. The arithmetic unit 66, furthermore, calculates and determines the steering assist force proportional to the trust force read in the described manner and transmits the assist fore control signal representing the steering assist force determined in the described manner to the motor control unit 68 through means of the output unit 67. The motor control unit 68 manipulates and preferably amplifies the assist force control signal and then transmits the amplified signal to the motor 38, whereby the controller 65 enables the motor 38 to generate the suitable steering assist force corresponding to the fluctuation of the steering load.

According to the described second embodiment, the controller 65 enables the motor 38 to generate the suitable steering assist force corresponding to the fluctuation of the steering load which is generally affected by means of the thrust force generated by means of the propeller 64 and the like force, thus reducing the steering load applied to the steering wheel 2 and, hence, the steering feeling can ge improved by means of the suitable steering assist force corresponding to the fluctuation of the steering load.

In addition, the thrust sensor 63 indirectly detects the thrust force generated by means of the propeller 64 in such a manner by directly detecting the pressure of the pressurized oil within the trim-up tube 76 of the existing opwer trim-tilt system 62, so that the thrust sensor 63 can be made compact and simplified with reduced cost.

In accordance with a first modification of the second embodiment, the thrust sensor 63 may be disposed within the tilt-up tube 73 of the power trim-tilt system 62 so as to thereby directly determine the pressure of the pressurized oil within the tilt-up tube 73, thus indirectly detecting the thrust force generated by means of the propeller 64, because the pressurized oil is also supplied to the tilt cylinder 70 as well as the trim cylinders 69*a* and 69*b* during the trim-up operation.

In accordance with a second modification of the second embodiment, the power trim-tilt system 62 is composed of a single hydraulic cylinder for attaining both the power trim effect and the power tilt effect. The thrust sensor may be mounted within a tube through which the pressurized oil is supplied from the oil pump 71 to the inner chamber of the hydraulic cylinder described above, thus indirectly detecting the thrust force generated by means of the propeller 64.

Figure 21:
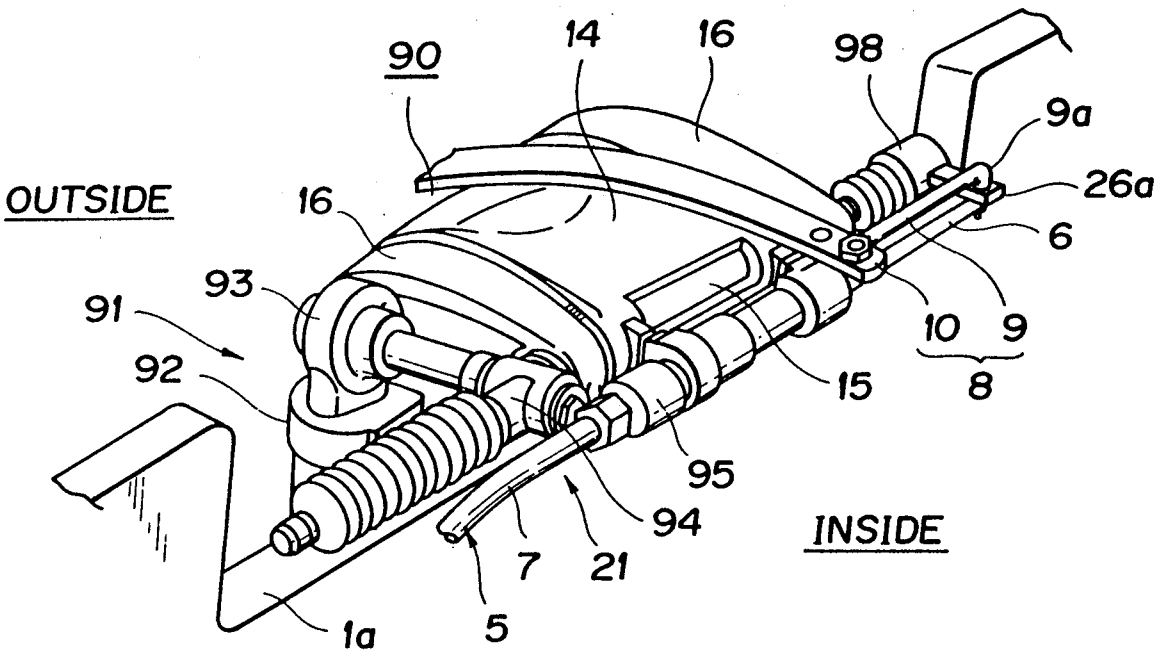
FIG. 21 is a partial perspective view of the power steering system of the third embodiment according to the present invention.
Figure 23:
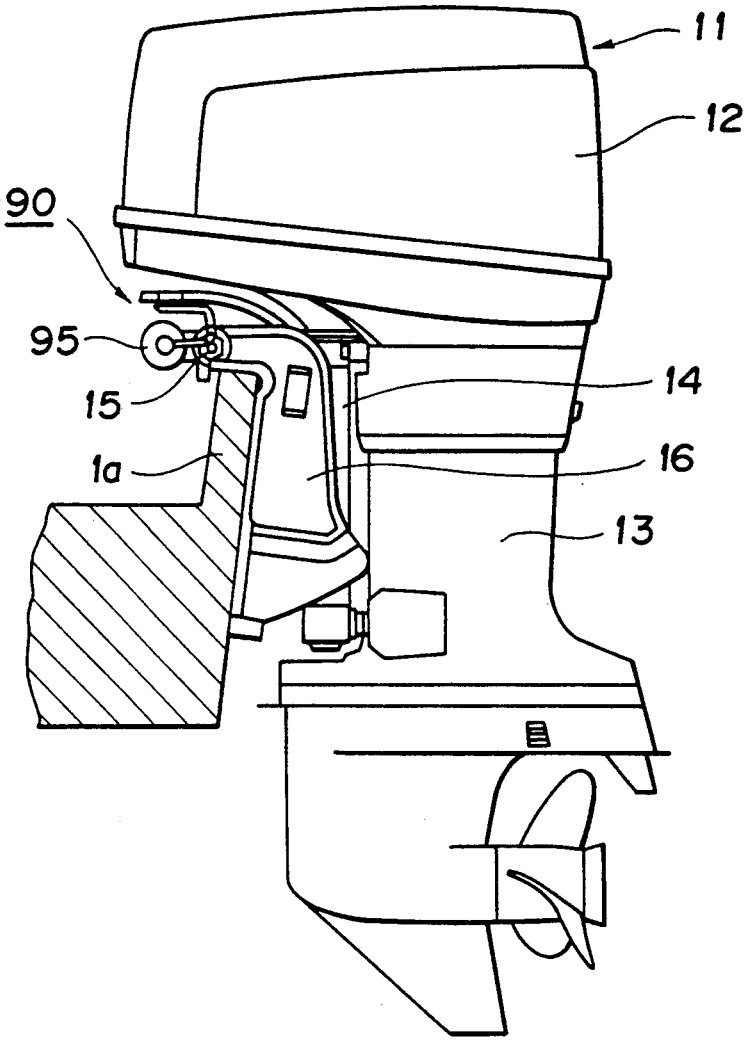
FIG. 23 is a side view of the outboard motor including the power steering system shown in FIGS. 21 and 22.

Referring to FIGS. 21 and 23 representing the third embodiment according to the present invention, FIG. 21 is a partial perspective view of a power steering system 90 of the third embodiment of the present invention, in which like reference numerals are used to designate portions or members corresponding to those used for the first embodiment shown in FIGS. 1 to 10 and, consequently, a detailed description thereof is now omitted herefrom.

Figure 22:
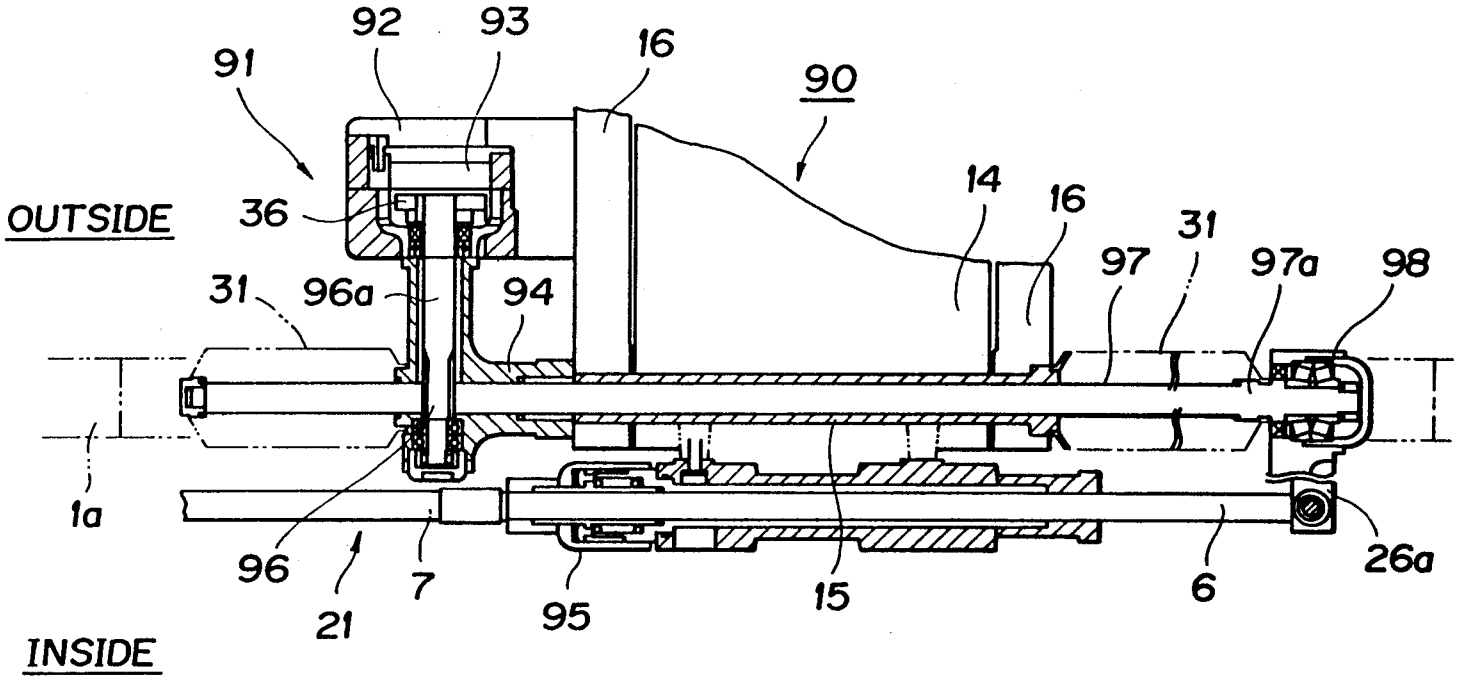
FIG. 22 is a longitudinal sectional view partially representing the power steering system shown in FIG. 21.

In the third embodiment, the power steering system 90 comprises the manual steering system 21 and a power unit 91. Referring to FIGS. 21 and 22, the power unit 91 is provided with a motor box 92 within which a motor 38 is accommodated, a gear box 93 in which the reduction gears 35 and 36 are accommodated, a rack box 94 in which a rack 97 and a pinion 96 are incorporated, and a sensor box 95 in which a potentiometer and a sensor rod constituting the steering torque sensor 32 are accommodated. The reduction gears 35 and 36, the rack 97 and the pinion 96 are constructed as a transmission means for transmitting the steering assist force generated by means of the motor 38 to the link mechanism 8 of the manual steering system 21. The motor box 92 and the gear box 93 are located outside the transom 1*a* of the hull, and the rack box 94 is disposed above, as viewed, an upper end surface of the transom 1*a* in parallel relationship with respect thereto. The sensor box 95 is coaxially mounted with respect to the inner cable 6 of the steering cable 5.

Namely, the motor box 92 is arranged outside the transom in such a manner that the longitudinal direction of the motor box 92 corresponds to the upward and downward direction as viewed, and the gear box 93 is integrally secured to the upper, as viewed, portion of the motor box 92. The reduction gear 35 secured to the motor shaft, not shown, is substantially perpendicularly engaged with the reduction gear 36 secured to the pinion shaft 96*a* extending horizontally as viewed, whereby the rotation force of the motor 38 changes to the horizontal direction from the vertical direction as shown in FIG. 21.

The rack box 94 which accommodates a pinion shaft 96*a* as well as the rack 97 and the pinion 96 is mounted to one of the clamp brackets 16 in a coaxial relationship with respect to the clamp bracket shaft 15 interposed between the clamp brackets 16 and 16. One of the bellows 31 is attached to the rack box 94 and the other bellow is attached to the end portion of the clamp bracket shaft 15 in such a manner as to extend outwardly beyond the other one of the clamp brackets 16. The rack 97 is coaxially accommodated within the rack box 94 and the hollow clamp bracket shaft 15 in an axially reciprocating manner and both axial ends of the rack 97 are incorporated in the bellows 31. The most outward end portion 97*a*, that is, the most rightward end as viewed in FIG. 22, of the rack 97 extends outside bellow 31 and is perpendicularly connected to the stay 26*a* through means of a free joint device 98 so as to thereby transmit the axial reciprocation of the rack 97 to the outboard motor body 12 through means of the link mechanism 8, whereby the outboard motor 12 can be steered in the bilateral direction.

According to the third embodiment described above, the motor box 92 and the gear box 93 are located outside the transom 1*a* of the hull 1 and the rack box 94 is disposed above the transom 1*a* and rearwardly of the steering cable 5, so that the power unit 91 composed of the motor box 92, the gear box 93, the rack box 94 and the like members is not mounted inside the hull 1, thus eliminating any reduction of the space of the hull 1. Accordingly, the power steering system 90 is able to be applied to a small sized craft, for example a small sized motor board, which normally or otherwise would not have sufficient space to accommodate such a power steering system, thereby improving the utility of the power steering system 90.

It is to be understood by persons skilled in the art that the present invention is not limited to the described embodiments and many other modifications and changes may be made without departing from the spirit and scope of the appended claims. It is therefore to be understood that within the scope of the appended claims, the present invention may be practiced otherwise than as specifically disclosed herein.

What is claimed is:

1. A power steering system for an outboard motor, for steering an outboard motor body of said outboard motor which is disposed outside of a rear portion of a hull of a watercraft and which is provided with an engine and a propeller driven by means of said engine, comprising:

a manual steering system mounted upon said hull for operating a steering element in order to manually steer said outboard motor body;

a power unit operatively connected to said manual steering system and including an electric motor for applying a steering assist force to said manual steering system;

a sensor means provided with a steering torque sensor for detecting steering torque applied to said steering element of said manual steering system during operation thereof, an engine speed sensor for detecting engine speed, and a steering angle sensor for detecting a steering angle and a steering direction of said outboard motor body when steered by said manual steering system; and a control means operatively connected to said sensor means for controlling said electric motor of said power unit by determining said steering assist force in response to said steering torque detected by said steering torque sensor and adjusting said determined steering assist force in response to said engine speed and said steering angle respectively detected by means of said engine speed sensor and said steering angle sensor.

2. A power steering system as set forth in claim 1, wherein said steering angle sensor comprises:

pinion means operatively connected to said manual steering system so as to rotate in either one of two opposite directions, said pinion means comprising a plurality of gear teeth; and sensor means disposed adjacent to said pinion means at a fixed position past which each of said gear teeth can movably pass as said pinion is rotated in either one of said two opposite directions for counting said gear teeth moved past said fixed position whereby said steering angle of said outboard motor body can be detected.

3. A power steering system as set forth in claim 2, wherein:

each of said gear teeth has a radially outer land portion defined thereon; and notch means are defined within said land portion of each of said gear teeth in an asymmetrical manner with respect to a longitudinal axis of each of said gear teeth such that said notch means is located at different distances from side portions of each of said gear teeth, whereby said sensor means can determine said steering direction of said outboard motor body.

4. A power steering system as set forth in claim 2, wherein:

each of said gear teeth of said pinion means comprises large and small land portions radially offset with respect to each other in a stepped manner such that together, asymmetrical land portions are defined upon each one of said gear teeth with respect to a longitudinal axis of each one of said gear teeth and with respect to side portions of each one of said gear teeth, whereby said sensor means can determine said steering direction of said outboard motor body.

5. A power steering system for an outboard motor having an outboard motor body and means for mounting the motor body on a transom having a front surface defining the rear of a watercraft hull interior space, the outboard motor being provided with an engine and a propeller driven by means of said engine, said steering system comprising:

a manual steering system mounted upon said hull for operating a steering element in order to manually steer said outboard motor body; and a power unit operatively connected to said manual steering system and including an electric motor for applying a steering assist force to said manual steering system, and transmission means for transmitting power generated by said electric motor to said manual steering system, said electric motor being within a motor box means located outside of said hull interior space and said outboard motor body and to the rear of the transom front surface when the motor body is mounted on the transom, and said transmission means being disposed within a transmission box means which is also located outside of said hull interior space and said outboard motor body and to the rear of the transom front surface when the motor body is mounted on the transom.

6. A power steering system according to claim 5, wherein and said transmission means comprises reduction gears, a rack and a pinion, said reduction gears being accommodated in a gear box located outside of the hull interior space and to the rear of the transom front surface, said rack and pinion being accommodated in a rack box located above the transom and to the rear of the transom front surface when the motor body is mounted on the transom.

7. A power steering system as set forth in claim 6, wherein:

said motor box means is disposed in a substantially vertical orientation with respect to said hull of said watercraft;

said gear box is operatively connected to an upper end of said motor box means; and said rack box is disposed horizontally and parallel tot he transom of said watercraft, whereby a compact arrangement of said power steering system, with respect to said manual steering system, is achieved.

8. A power steering system for an outboard motor, for steering an outboard motor body of said outboard motor which is disposed outside of a rear portion of a hull of a watercraft and which is provided with an engine and a propeller driven by means of said engine, comprising:

a manual steering system mounted upon said hull for operating a steering element in order to manually steer said outboard motor body;

a power unit operatively connected to said manual steering system and including an electric motor for applying a steering assist force to said manual steering system;

a sensor means provided with a thrust sensor for detecting a thrust force generated by means of said propeller of said outboard motor; and control means operatively connected to said sensor means for controlling said electric motor of said power unit by determining said steering assist force in proportion to said thrust force detected by means of said thrust sensor.

9. A power steering system according to claim 8, wherein said outboard motor is provided with a power trim-tilt system for automatically trimming and tilting the outboard motor body and said thrust sensor directly detects the pressure of pressurized oil operating the power trim-tilt system so as to indirectly detect the thrust generated by the propeller.

* * * * *